US006974317B2

(12) United States Patent
Sumrall

(10) Patent No.: US 6,974,317 B2
(45) Date of Patent: Dec. 13, 2005

(54) LIGHTWEIGHT CONCRETE COMPOSITE BLOCKS

(75) Inventor: Orbin F. Sumrall, San Antonio, TX (US)

(73) Assignee: Amazon Forms One, Inc., San Antonio, TX (US)

( * ) Notice: Subject to any disclaimer, the term of this patent is extended or adjusted under 35 U.S.C. 154(b) by 279 days.

(21) Appl. No.: 10/374,886

(22) Filed: Feb. 26, 2003

(65) Prior Publication Data

US 2003/0141615 A1 Jul. 31, 2003

Related U.S. Application Data

(63) Continuation-in-part of application No. 09/887,369, filed on Jun. 22, 2001, now Pat. No. 6,827,570.

(60) Provisional application No. 60/360,695, filed on Mar. 1, 2002.

(51) Int. Cl.[7] ..... B28B 5/04; B28B 13/02; B28B 13/04

(52) U.S. Cl. ..... 425/219; 425/259; 425/261; 425/438; 425/442; 425/443; 425/451.9; 425/453; 425/447

(58) Field of Search ..... 425/219, 259, 425/261, 438, 442, 443, 451.9, 453, 441, 425/447

(56) References Cited

U.S. PATENT DOCUMENTS

| | | | | | |
|---|---|---|---|---|---|
| 1,001,952 | A | * | 8/1911 | Henley | 425/453 |
| 1,541,206 | A | * | 6/1925 | Bruce | 425/440 |
| 1,550,014 | A | * | 8/1925 | Debay | 425/134 |
| 1,882,682 | A | * | 10/1932 | Abram | 425/168 |
| 1,905,619 | A | * | 4/1933 | Carton | 425/556 |
| 2,877,524 | A | * | 3/1959 | Bishop | 366/19 |
| 3,140,610 | A | * | 7/1964 | Lanham | 73/321 |
| 3,419,648 | A | * | 12/1968 | Leach | 264/53 |
| 3,521,367 | A | * | 7/1970 | Grynovich et al. | 33/715 |
| 4,105,383 | A | * | 8/1978 | Hanson | 425/96 |
| 4,276,774 | A | * | 7/1981 | McGookin | 73/290 B |
| 4,831,801 | A | * | 5/1989 | Stracke | 52/309.1 |
| 4,895,450 | A | * | 1/1990 | Holik | 366/18 |
| 5,522,658 | A | * | 6/1996 | John | 366/15 |
| 5,564,823 | A | * | 10/1996 | Holik | 366/6 |
| 6,676,862 | B2 | * | 1/2004 | Jensen | 264/39 |
| 6,827,570 | B2 | * | 12/2004 | Sumrall et al. | 425/219 |

FOREIGN PATENT DOCUMENTS

| | | | | | |
|---|---|---|---|---|---|
| DE | 2415970 | A | * | 10/1975 | B28B 1/00 |
| DE | 2737186 | A | * | 5/1979 | B28B 1/08 |
| FR | 2624047 | A | * | 6/1989 | B28B 15/00 |
| JP | 05004210 | A | * | 1/1993 | B28B 11/00 |
| RU | 2078690 | C1 | * | 5/1997 | B28B 5/00 |
| SU | 1689075 | A | * | 11/1991 | B26B 7/22 |

* cited by examiner

*Primary Examiner*—Robert B. Davis
(74) *Attorney, Agent, or Firm*—Christopher L. Makay

(57) ABSTRACT

An apparatus for manufacturing lightweight concrete composite blocks includes a form, a station conveyor, a form-loading station, a form assembly station, a curing oven, and a block removal station. The station conveyor conveys the form or a multitude of forms around the apparatus in a continuous loop to produce a desired rate of production of lightweight concrete composite blocks. The form-loading station fills the form with a lightweight concrete composite. The form assembly station assembles the form to seal the composite within the form. The curing oven cures the lightweight concrete composite into a lightweight concrete composite block. The block removal station removes the lightweight concrete composite block from the form prior to the return of the form to the form-loading station for re-use.

11 Claims, 10 Drawing Sheets

LIGHTWEIGHT CONCRETE COMPOSITE BLOCKS

CROSS-REFERENCE TO RELATED APPLICATIONS

This application is a continuation-in-part of application Ser. No. 09/887,369, which was filed Jun. 22, 2001 now U.S. Pat. No. 6,825,570. This application further claims all available benefit, under 35 U.S.C. § 119(e), of U.S. provisional patent application Ser. No. 60/360,695, which was filed Mar. 1, 2002.

BACKGROUND OF THE INVENTION

1. Field of the Invention

The present invention relates to lightweight concrete and, more particularly, but not by way of limitation, to unitary lightweight concrete composite blocks, an apparatus and corresponding method for manufacturing unitary lightweight concrete composite blocks, and a method of using unitary lightweight concrete composite blocks.

2. Description of the Related Art

The primary building materials utilized today are wood and concrete. Wood unfortunately has become extremely expensive due to reduced supplies caused by restrictions resulting from today's environmentally conscious society. Further, wood often does not provide the structural safety available from other building materials, such as concrete. Concrete is unfortunately expensive, which restricts its use to projects requiring the structural safety advantages associated with concrete.

Thus, the building industry constantly seeks to reduce building costs while at least meeting or actually improving upon structural safety standards. One such improved product consists of lightweight concrete, which is composed of water, cement, and polystyrene. Lightweight concrete provides reduced costs in materials by replacing cement with less expensive polystyrene. Lightweight concrete further provides structural safety comparable to cement and improved over wood.

Unfortunately, the reduced materials costs of lightweight concrete are counteracted through manufacturing difficulties, which drive up costs. Currently, lightweight concrete is virtually manufactured manually in that lightweight concrete slurries are poured into molds and allowed to cure but, upon removal from molds, must be glued together and trimmed before a block sufficient for use exists. Furthermore, there does not currently exist lightweight concrete blocks suitable for use in constructing interior walls. Accordingly, unitary lightweight concrete composite blocks that are easy to manufacture and are suitable for use in constructing interior walls would significantly improve over the foregoing related art.

SUMMARY OF THE INVENTION

In accordance with the present invention, lightweight concrete composite blocks are suitable for use in constructing walls. Such blocks are lightweight concrete composite that may be cured into the shape of a wall, which includes first and second sidewalls, first and second endwalls, and first and second faces including a depth therebetween. A conduit may be disposed within the depth between the first and second faces. At least one end of the conduit typically protrudes from the block, and the conduit may be plumbing piping or electrical conduit. One end of the conduit may connect to an electrical box disposed within the depth between the first and second faces. The first sidewall may include a tongue and the second sidewall may include a groove.

An apparatus for manufacturing lightweight concrete composite blocks includes a form, a form loading station, a form assembly station, a station conveyor, a curing oven, and a block removal station. The form defines a desired shape that holds a volume of composite. The form loading station receives composite and delivers the composite to the form. The form assembly station facilitates assembly of the form. The station conveyor conveys the form about the apparatus in a continuous loop. The curing oven cures the composite into a lightweight concrete composite block. The block removal station removes the lightweight concrete composite block from the form.

The form includes a bottom assembly and a cap that seats on the bottom assembly. The form further includes a mating assembly that couples the bottom assembly with the cap. The form still further includes an insert that shortens the form to produce smaller lightweight concrete composite blocks. The bottom assembly includes walls, mating assemblies that couple the walls together, and a conduit notch that supports a conduit within the bottom assembly at a designated depth. Upon the curing of the composite into a lightweight concrete composite block, the conduit remains disposed within the block at the designated depth.

The form loading station includes a cap removal/replacement assembly that removes and replaces a cap of the form and a screed assembly that receives composite and delivers the composite into a bottom assembly of the form. The cap removal/replacement assembly includes lifting rails adapted to engage a cap bracket of the form, a stabilizer bar connecting the lifting rails, and a lifting cylinder attached to the stabilizer bar that moves between an engagement position and a raised position. The screed assembly includes a screed track extending over the station conveyer, a screed box coupled with the screed track, a screed cylinder coupled with the screed box that conveys the screed box along the screed track between a retracted position and a loading position, a leveling hopper disposed within the screed box that fills and levels the form with composite, an auger disposed within the leveling hopper that evenly distributes composite into the form, a screed motor for rotating the auger, and a leveling cylinder coupled with the leveling hopper that slides the leveling hopper back and forth inside the screed box.

The station conveyor conveys the form or a multitude of forms around the apparatus in a continuous loop to produce a desired rate of production of lightweight concrete composite blocks. A first station conveyor conveys unloaded forms to the form loading station. A loading conveyor receives from the first station conveyor unloaded forms for filling with composite and delivers loaded forms from the form loading station. A first roller conveyor receives from the loading conveyor loaded forms and delivers the loaded forms to the form assembly station. A second station conveyor receives from the first roller conveyor loaded forms and conveys loaded and assembled forms from the form assembly station through the curing oven and to the block removal station. An unloading conveyor receives from the second station conveyor forms filled with cured composite and delivers unloaded forms from the block removal station. A second roller conveyor receives from the unloading conveyor unloaded forms and delivers the unloaded forms to the first station conveyor.

The block removal station includes a cap removal/lockdown assembly that removes and replaces a cap of the form and that locks down a bottom assembly of the form, a dispatch assembly that removes a cured block from a locked down bottom assembly of the form, a frame that supports the cap removal/lockdown assembly and the dispatch assembly, and a dispatch conveyor that receives a removed cured block from the dispatch assembly and conveys the removed cured block therefrom. The cap removal/lockdown assembly includes at least one lifting rail adapted to engage a cap bracket attached to the cap of the form, at least one lockdown rail pivotally connected to the lifting rail and adapted to engage a pin attached to the bottom assembly of the form, and at least one lifting cylinder attached to the lifting rail and movable between an engagement position whereby the lifting rail engages the cap bracket and a lockdown position whereby the lifting cylinder raises the lifting rail to remove the cap from the bottom assembly and pivots the lockdown rail such that the lockdown rail engages the pin to lock down the bottom assembly of the form. The dispatch assembly includes at least one dispatch cylinder mounted on the frame and a ram plate hingedly attached to the dispatch cylinder for pushing a lightweight concrete composite block from the form.

A method for manufacturing lightweight concrete composite blocks includes loading composite into a form of a desired shape, assembling the form loaded with composite, curing the composite into a lightweight concrete composite block, and removing the lightweight concrete composite block from the form. The method for manufacturing lightweight concrete composite blocks further includes placing a conduit within the form at a designated depth prior to loading composite into a form. Loading the composite into a form of desired shape includes removing a cap of the form from a bottom assembly of the form, delivering composite into the bottom assembly of the form, and replacing the cap onto the bottom assembly. Assembling the form loaded with composite includes depressing a cap of the form onto a bottom assembly of the form and coupling a latch attached to the cap with a catch attached to the bottom assembly. Removing the lightweight concrete composite block from the form includes uncoupling the latch attached to the cap of the form from the catch attached to the bottom assembly of the form, removing the cap from the bottom assembly, locking down the bottom assembly of the form, uncoupling latches securing sidewalls of the bottom assembly to endwalls of the bottom assembly, rotating the sidewalls away from the endwalls, and pushing a lightweight concrete composite block from the locked down bottom assembly.

A method of assembling lightweight concrete composite blocks into a structure includes erecting a support frame, inserting blocks into the support frame, securing the blocks together, and securing the blocks to the support frame. The method of assembling lightweight concrete composite blocks into a structure further includes erecting a second level support frame, inserting blocks into the second level support frame, securing the blocks together, and securing the blocks to the second level support frame. The method of assembling lightweight concrete composite blocks into a structure further includes cutting an opening into a block and installing a door or window in the opening. The method of assembling lightweight concrete composite blocks into a structure further includes attaching a cabinet support frame to a block, inserting a cabinet into the cabinet support frame, and securing the cabinet to the cabinet support frame and to the block.

It is therefore an object of the present invention to provide lightweight concrete composite blocks suitable in building walls.

It is another object of the present invention to provide an apparatus and corresponding method for manufacturing lightweight concrete composite blocks.

It is a further object of the present invention to provide a method of using lightweight concrete composite blocks in constructing a structure.

Still other objects, features, and advantages of the present invention will become evident to those of ordinary skill in the art in light of the following.

DETAILED DESCRIPTION OF THE PREFERRED EMBODIMENT

Figure 11:
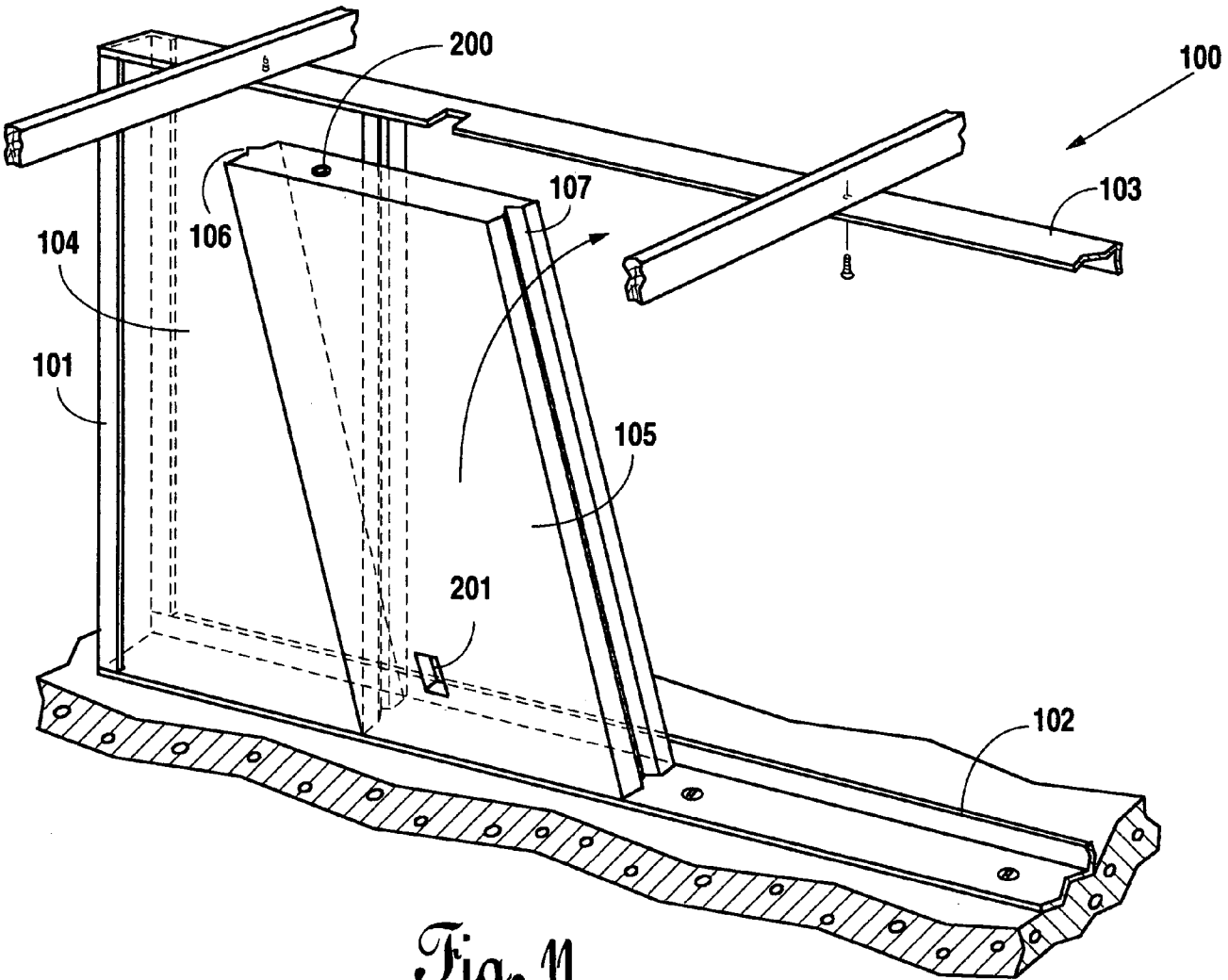
FIG. 11 is a perspective view illustrating a standard installation.

As illustrated in FIG. 11, the preferred embodiment of the block 10A discloses a rectangular block with a top end, a bottom end, and two sides. One side defines a raised tongue 106 while the opposite side defines a recessed groove 107, whereby blocks can be assembled in a successive fashion by fitting a tongue side into a groove side. In addition, the block 10A includes electrical conduit 200 and electrical boxes 201 for running electrical wire and making electrical connections. While the preferred embodiment discloses electrical conduit 200 and electrical boxes 201, those of ordinary skill in the art will recognize that any multitude of items normally used inside building walls may be substituted, such as plumbing piping, air ducts, and the like. The ability of the block 10A to contain electrical conduit and electrical boxes makes it ideal for use as an interior wall in buildings.

Figure 10:
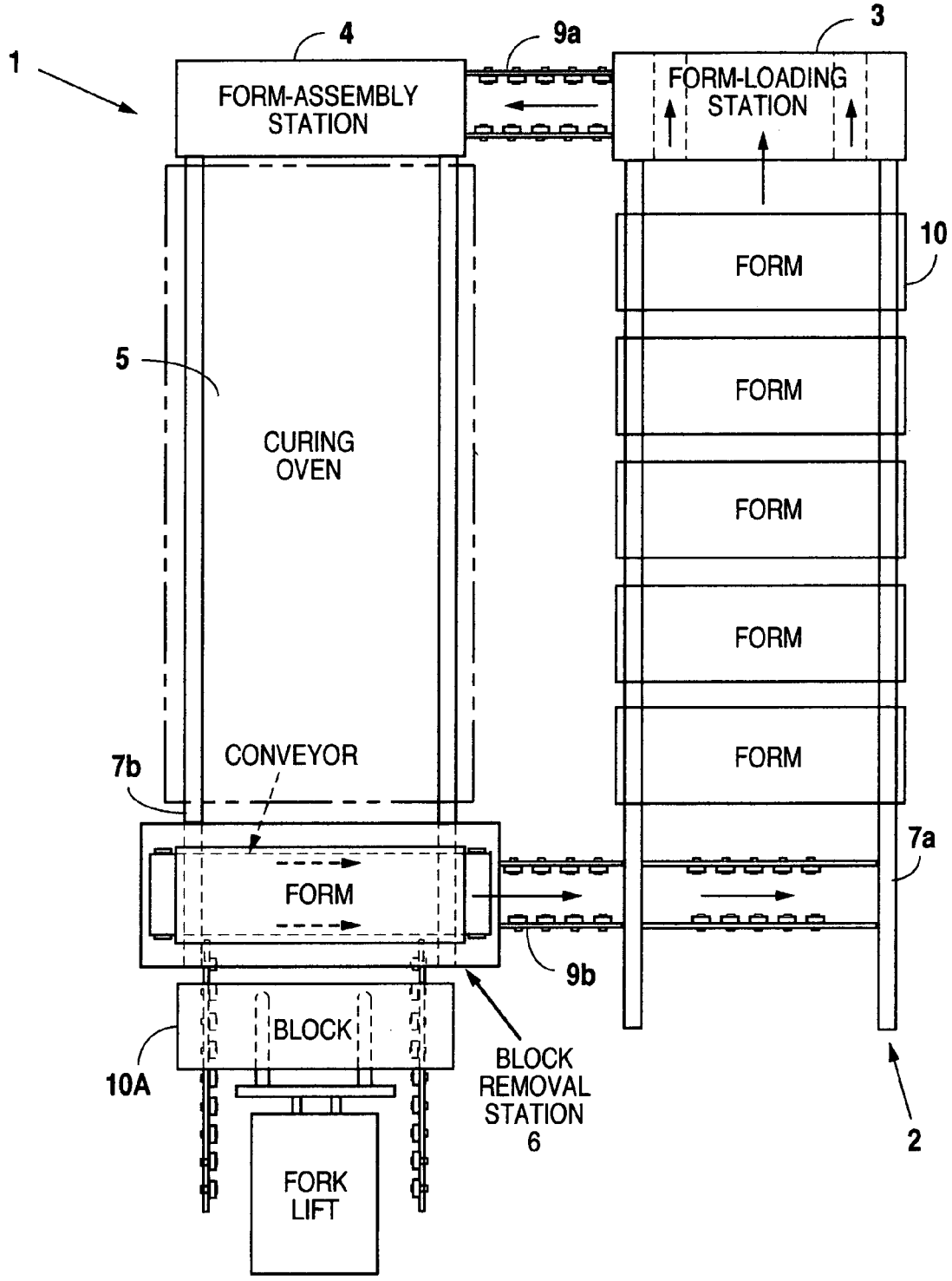
FIG. 10 is a plan view illustrating an apparatus for manufacturing unitary lightweight concrete composite blocks according to the preferred embodiment.

As illustrated in FIG. 10, an apparatus 1 for manufacturing unitary lightweight concrete composite blocks 10A includes a form 10, a conveyor system 2, a form-loading station 3, a form assembly station 4, a curing oven 5, and a block removal station 6. The apparatus 1 utilizes a method for manufacturing unitary lightweight concrete composite blocks 10A that includes the steps of loading a form with lightweight concrete composite, curing the lightweight concrete composite, and removing a unitary lightweight concrete composite block 10A from the form.

As illustrated in FIGS. 1–6, a form 10 is used to cure the lightweight concrete composite into a desirable shape, which, in the preferred embodiment, is a unitary lightweight concrete composite block 10A. Thus, the preferred form 10 includes a bottom assembly 11 and a cap 12. Although the preferred embodiment discloses a unitary block 10A, those of ordinary skill in the art will recognize that a form producing any desirable shape, such as a square, circle, or angle may be utilized.

In the preferred embodiment, the bottom assembly 11 is a rectangular plate 14 with two sidewalls 15 and two endwalls 16. Each sidewall 15 is hingedly attached along a respective long length of the rectangular plate 14. In addition, each sidewall 15 defines a lengthwise channel 17 for forming a tongue 106 or groove 107 along the sides of each block. In the preferred embodiment, one sidewall 15 defines a channel 17 for forming a tongue 106, while the opposite sidewall 15 defines a channel 17 for forming a groove 107 (see FIG. 11). Consequently, finished blocks can be assembled in a successive fashion by fitting a tongue side into a groove side. While, the preferred embodiment discloses a bottom assembly 11 with sidewalls 15 with one tongue channel and one groove channel, those of ordinary skill in the art will recognize that, any combination of tongue and groove channels 17, or any channel profile, may be utilized. Furthermore, the long edge of each sidewall 15 terminates in an L-shaped lip. Also, T-shaped latches 18 are hingedly attached to each corner of each sidewall 15, which rotate between locked and unlocked positions.

Figure 2:
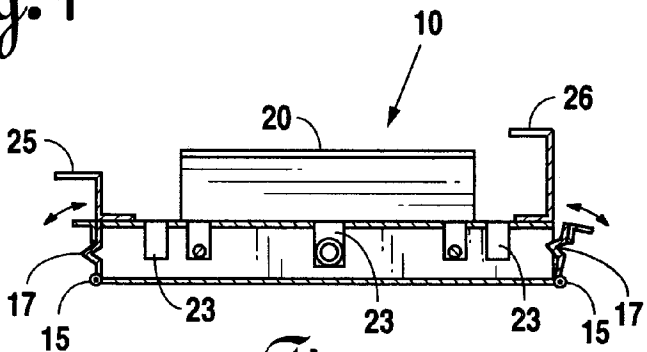
FIG. 2 is an end view illustrating a preferred embodiment of the form.
Figure 6:
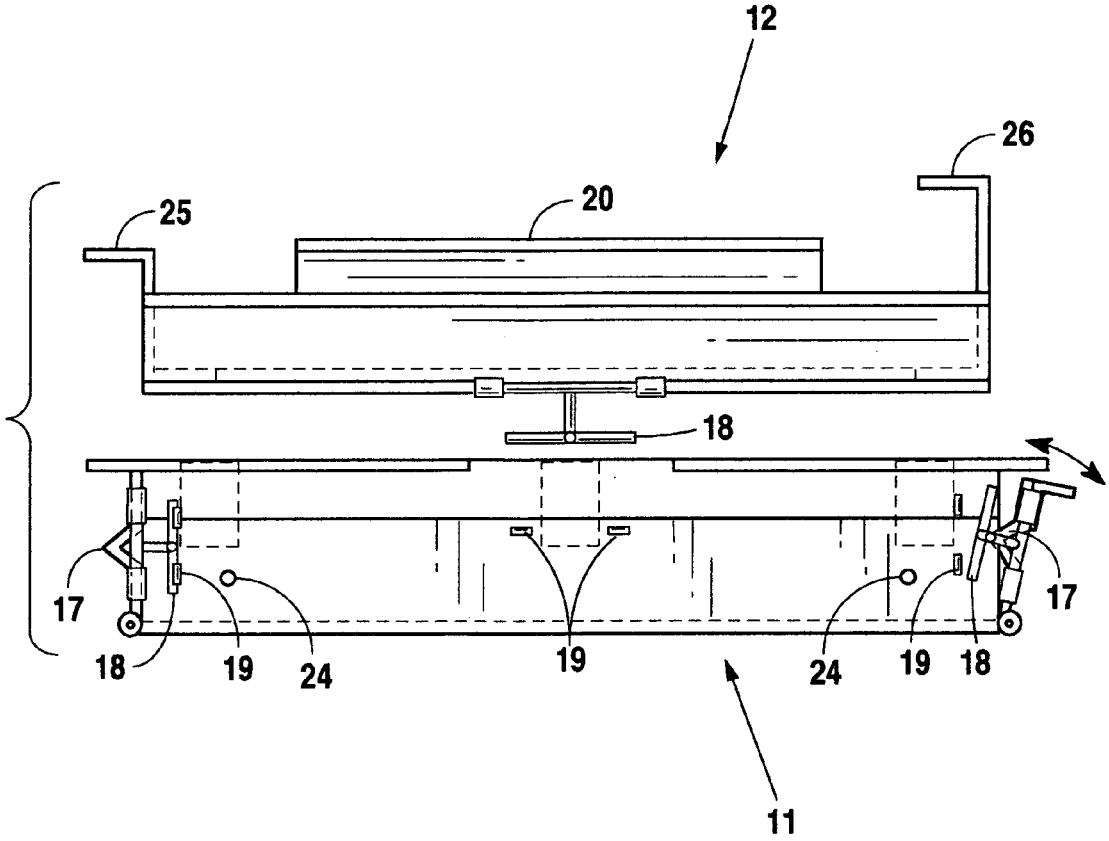
FIG. 6 is an end view illustrating the form with the cap removed.

Referring to FIGS. 2 and 6, each endwall 16 is attached along a respective short length of the rectangular plate 14. Catches 19 are fixedly attached by any suitable means, such as welding, at each corner and in the middle of each endwall 16 for coupling with the latches 18. The long edge of each endwall 16 terminates in an L-shaped lip, and pins 24 extend outward perpendicularly from each corner of each endwall 16. In addition, one endwall 16 defines conduit notches 23 for supporting electrical conduit and electrical boxes inside the form 10. The conduit notches 23 suspend the electrical conduit and electrical boxes at a designated depth during the curing process. Consequently, the electrical conduit and electrical boxes will reside at the designated depth in the finished block 10A. While the preferred embodiment of the insert discloses three conduit channels 23, those of ordinary skill in the art will recognize that any number of conduit channels 23 may be utilized to support any multitude of different objects.

To assemble the bottom assembly 11, the sidewalls 15 rotate up to a vertical position, thereby forming a rectangular box. Next, the latches 18 rotate to the locked position and couple with the catches 19, thereby securing the bottom assembly 11. This will be referred to as the assembled position. To disassemble the bottom assembly, the latches 18 uncouple from the catches 19 and the sidewalls 15 rotate down to a horizontal position. This will be referred to as the disassembled position.

Figure 3:
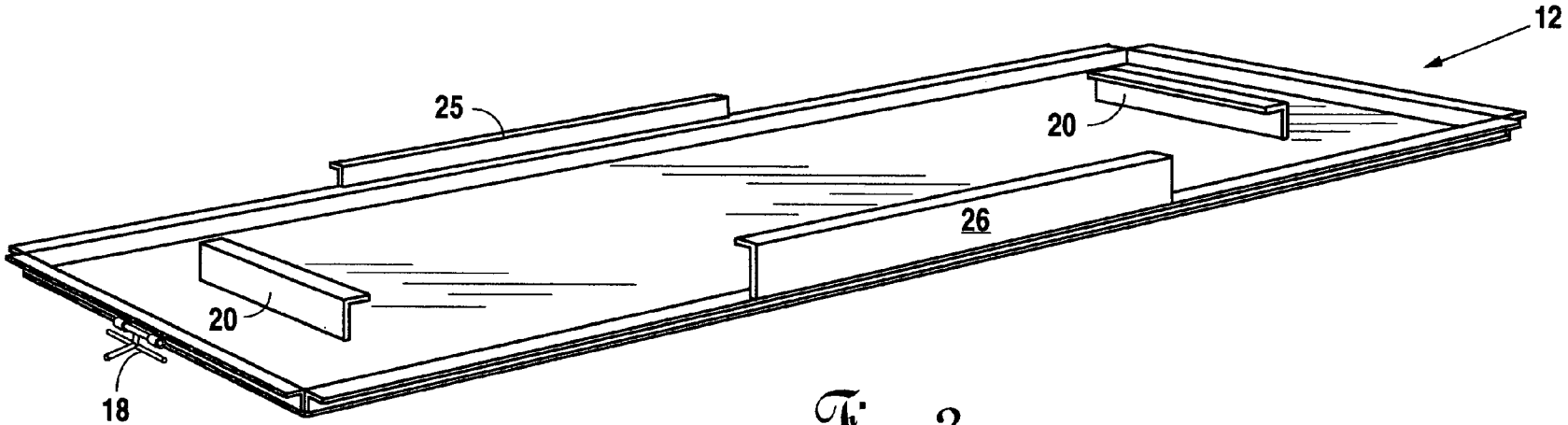
FIG. 3 is a perspective view illustrating a preferred embodiment of a cap of the form.

Referring to FIG. 3, the cap 12 is a rectangular plate with each long edge terminating in an L-shaped lip. Two L-shaped cap brackets 20 are attached by any suitable method, such as welding, to each end of the cap 12 so that the cap brackets 20 are parallel with the two short edges of the cap 12 and face inward, thereby defining slots between the top of the cap 12 and each cap bracket 20. An L-shaped short bracket 25 is attached by any suitable method, such as welding, to a front edge of the cap 12 so that the L-shape is facing outward. An L-shaped tall bracket 26 is attached by any suitable method, such as welding, to a back edge of the cap 12 facing the same direction as the short bracket 25. A latch 18 is hingedly attached to middle of each short edge of the cap 12, which rotates from an unlocked to a locked position. The perimeter dimensions of the cap 12 match the perimeter dimensions of the bottom assembly 11. When placed onto a bottom assembly 11 in the assembled position, the latches 18 of the cap 12 couple with the catches 19 of the bottom assembly 11 to seal the form 10, which will be referred to as the locked position. The latches 18 may also be uncoupled from the catches 19 of the bottom assembly 11 to release the cap 12, which will be referred to as the unlocked position.

Figure 4:
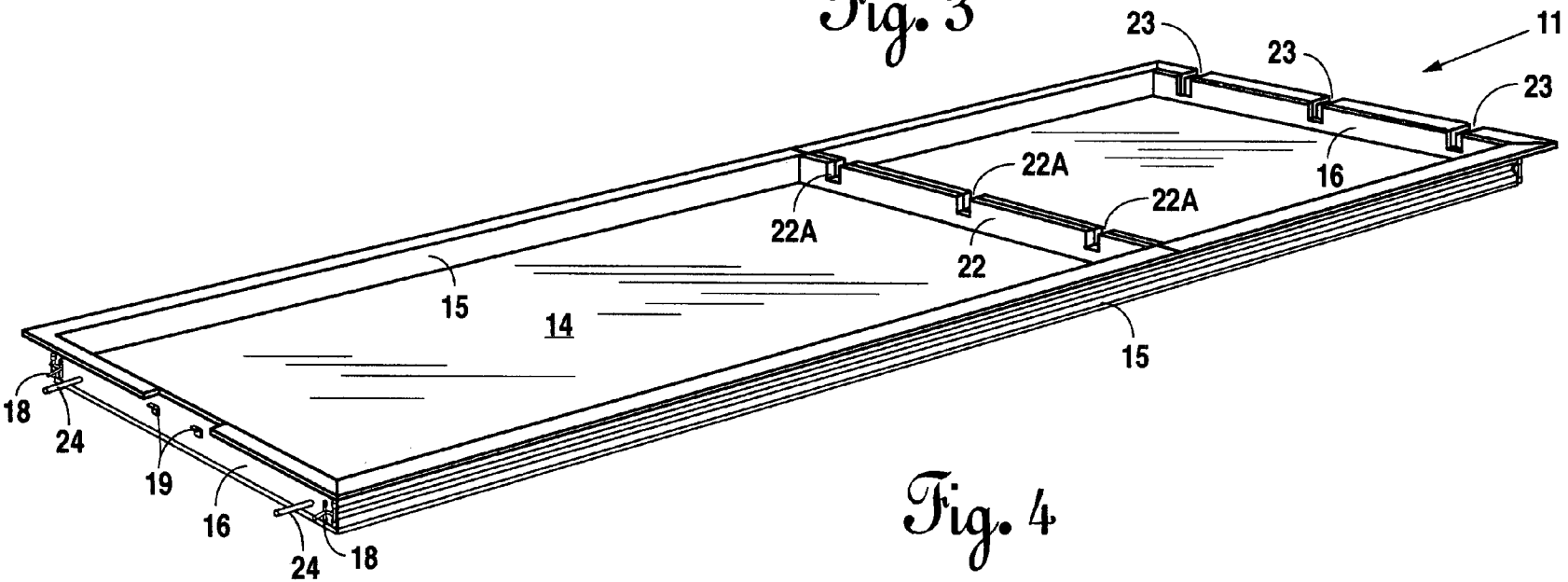
FIG. 4 is a perspective view illustrating a preferred embodiment of a bottom assembly of the form including an insert therein.
Figure 5:
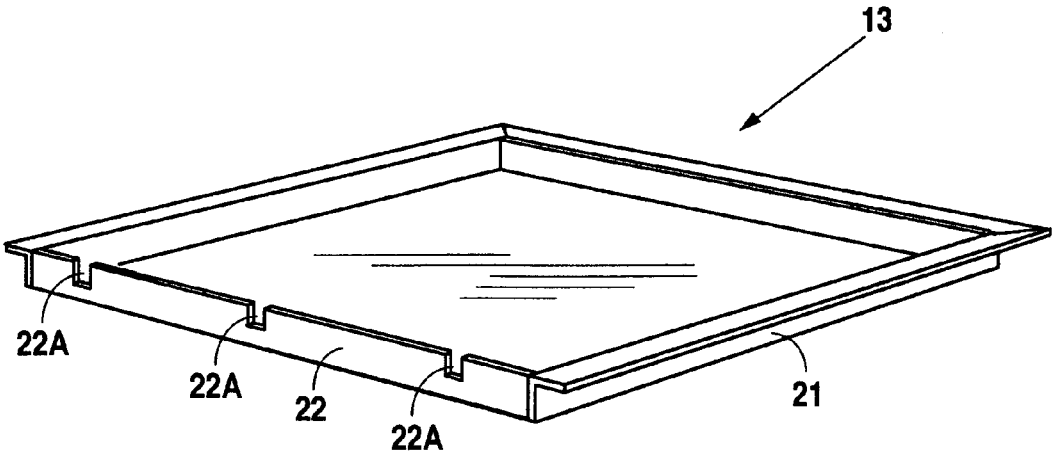
FIG. 5 is a perspective view illustrating an insert of the form.

Referring to FIGS. 4 and 5, an insert 13 is a rectangular plate with two sidewalls 21 and two endwalls 22. The dimensions of insert 13 are such that the insert 13 fits inside the bottom assembly 11. The two sidewalls terminate in an L-shaped lip. The insert 13 prevents lightweight composite concrete from filling the area of the form 10 occupied by the insert 13. Thus, the insert 13 shortens the overall length of the form 10 to produce a shorter block 10A. While the preferred embodiment discloses an insert 13 that shortens the form 10 by approximately ⅓, those of ordinary skill in the art will recognize that any size insert 13 may shorten the length of the form 10 by any length. One endwall 22 defines conduit notches 22A for supporting electrical conduit and electrical boxes inside the form. The conduit notches 22A suspend the electrical conduit and electrical boxes at a designated depth during the curing process. Consequently, the electrical conduit and electrical boxes will reside at the designated depth in the finished block 10A. While the preferred embodiment of the insert discloses three conduit notches 22A, those of ordinary skill in the art will recognize that any number of conduit notches 22A may be utilized to support any multitude of different objects.

As illustrated in FIGS. 7–10, a conveying system 2 routes a plurality of forms 10 in a continuous loop simultaneously through all the stations of the apparatus 1, thereby creating a time efficient process. The conveyor system 2 includes a first station conveyor 7*a*, a loading conveyor 8*a*, a first roller conveyor 9*a*, a second station conveyor 7*b*, an unloading conveyor 8*b*, and a second roller conveyor 9*b*. The first station conveyor 7*a* is the station conveyor disclosed in U.S. patent application Ser. No. 09/887,369, the disclosure of which is incorporated herein by reference. While the preferred embodiment discloses the station conveyor in U.S. patent application Ser. No. 09/887,369, those of ordinary skill in the art will recognize that any type of conveying apparatus may be utilized. The loading conveyor 8*a* is a belt conveyor well known to those of ordinary skill in the art. While the preferred embodiment discloses a belt conveyor, those of ordinary skill in the art will recognize that any conveying apparatus may be utilized. The second station conveyor 7*b* is the station conveyor disclosed in U.S. patent application Ser. No. 09/887,369, the disclosure of which is incorporated herein by reference. While the preferred embodiment discloses the station conveyor in U.S. patent application Ser. No. 09/887,369, those of ordinary skill in the art will recognize that any type of conveying apparatus may be utilized. The unloading conveyor 8*b* is a belt conveyor that is well known in the art. While the preferred embodiment discloses a belt conveyor, those of ordinary skill in the art will recognize that any conveying apparatus may be utilized.

Figure 1:
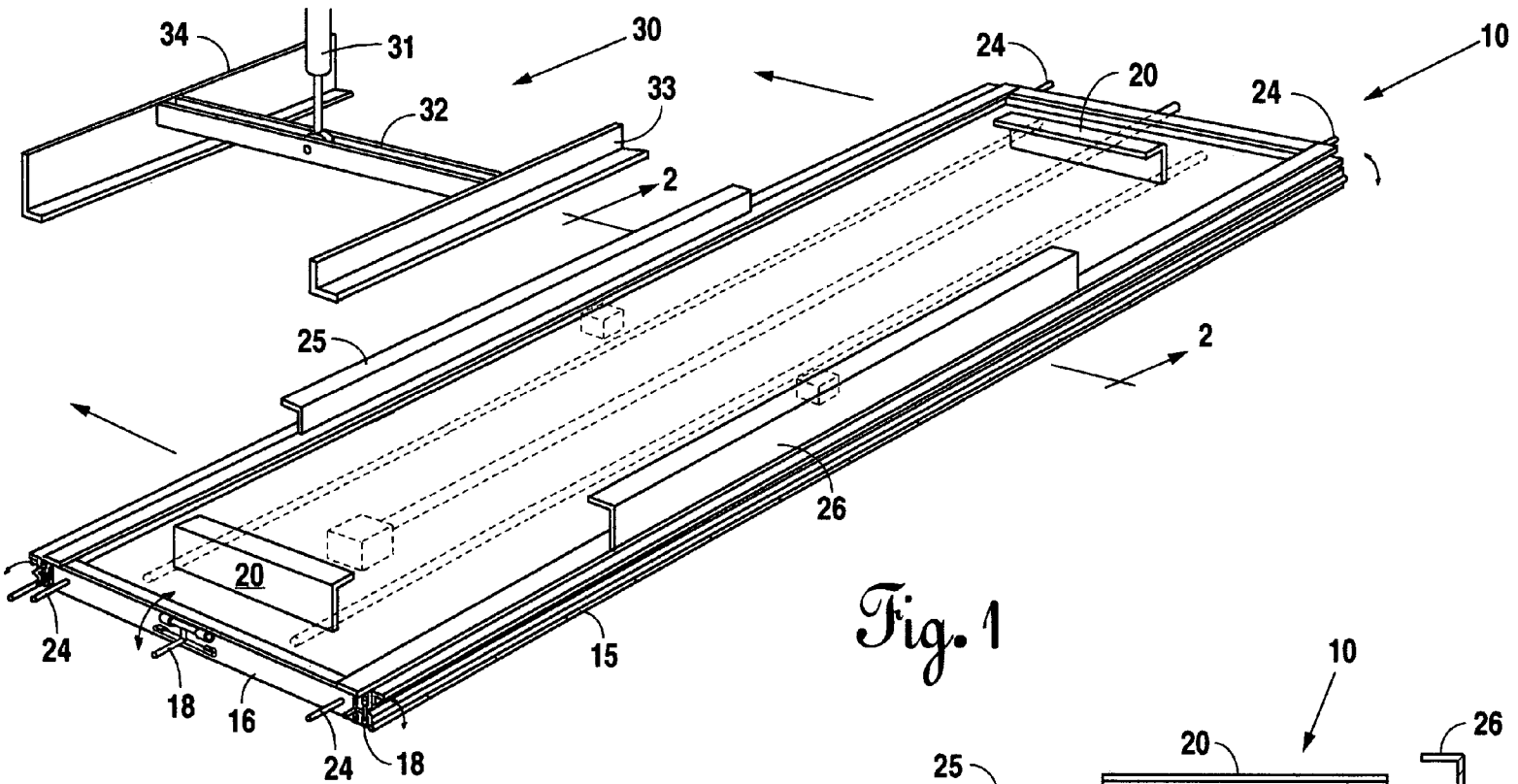
FIG. 1 is a perspective view illustrating a preferred embodiment of a form.
Figure 8:
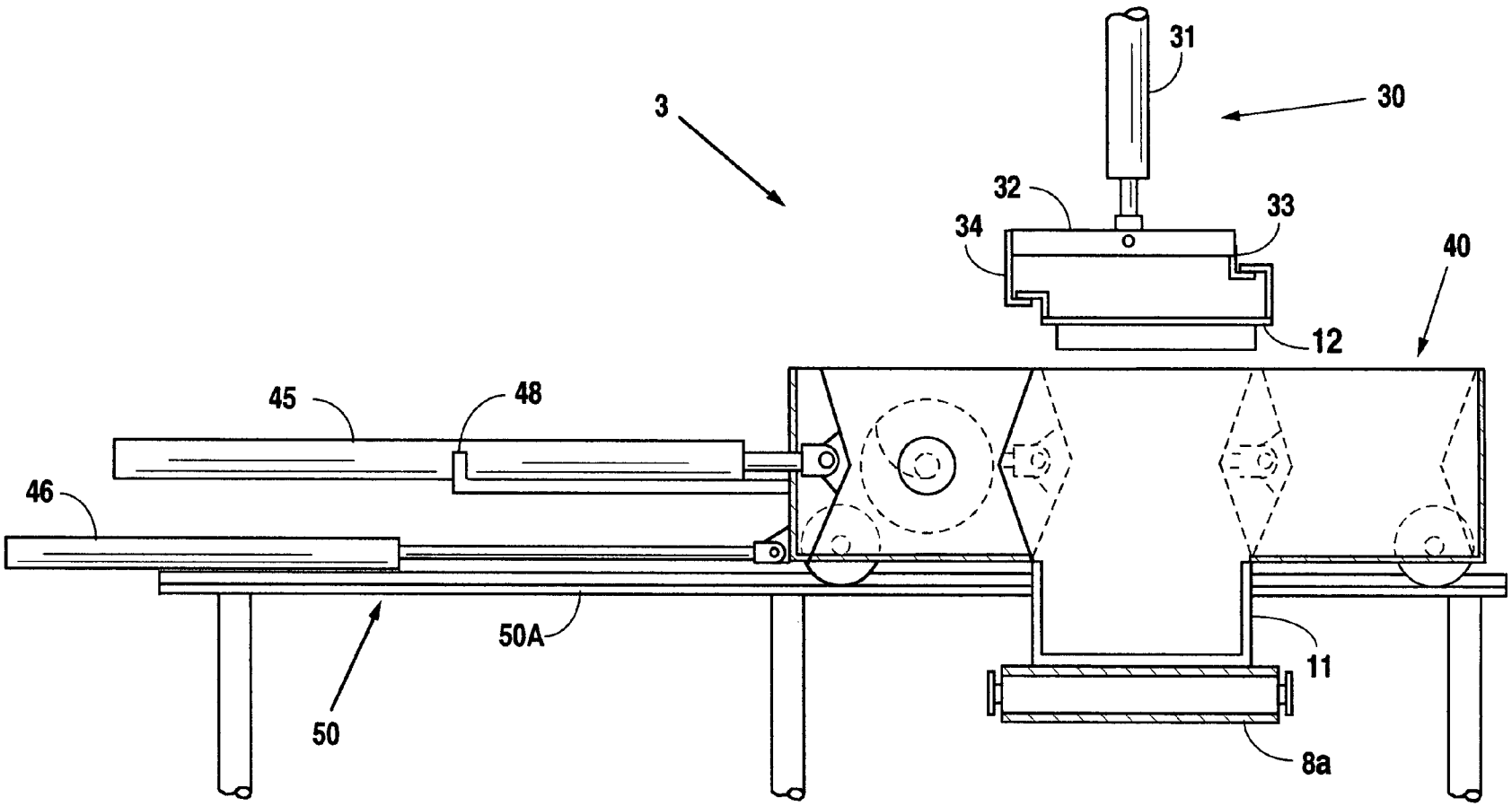
FIG. 8 is a side view illustrating the screed assembly for loading and leveling a form.

The form-loading station 3 includes a cap removal/replacement assembly 30 and a screed assembly 40. Referring to FIGS. 1 and 8, the cap removal/replacement assembly 30 includes a lifting cylinder 31, a stabilizer bar 32, a short lifting rail 33, and a tall lifting rail 34. The lifting cylinder 31 is vertically suspended above the loading conveyor 8*a* and connects by any suitable means, such as a pin, to the center of the stabilizer bar 32 so that the stabilizer bar resides in a horizontal plane. The short lifting rail 33 is an L-shaped rail that is attached to a back end of the stabilizer bar 32. The tall lifting rail 34 is an L-shaped rail that is attached to a front end of the stabilizer bar 32. When the lifting cylinder 31 extends, the short lifting rail 33 and tall lifting rail 33 lower to a position where they may engage a corresponding tall cap bracket 26 and short cap bracket 25, which will be referred to as the engagement position. When the lifting cylinder 31 retracts, the short lifting rail 33 and the tall lifting rail 34 raise to a position above the screed assembly 40, which will be referred to as the raised position.

The screed assembly 40 includes a frame 50 having supporting legs and screed tracks 50A attached thereto. The legs mount to the foundation on either side of the conveying system 3 by any suitable means, such as brackets attached to each leg and bolts sunk into a foundation. The screed assembly 40 further includes a screed box 41, a leveling hopper 42, an auger 43, a screed motor 44, two leveling cylinders 45, a screed cylinder 46, a filling conveyor 47, and a mounting bracket 48. The screed box 41 is a rectangular box with an open top and a slot in the bottom the same size as the top opening of the form 10. The edges of the screed box 41 rest within the screed tracks 50A, which run perpendicular to the loading conveyor 8*a*. The screed cylinder 46 is connected to the frame 50 between an end of the screed track 50A and a side of the screed box 41. When the screed cylinder 46 extends, it slides the screed box 41 directly over the loading conveyor 8A, which will be referred to as the loading position. When the screed cylinder 46 retracts, it slides the screed box 41 to a position adjacent the loading conveyor 8A, which will be referred to as the retracted position.

The leveling hopper 42 resides inside the screed box 41. The two leveling cylinders 45, which are any suitable hydraulically or pneumatically operated cylinders, connect from the screed box 41 to the leveling hopper 42 using a mounting bracket 48. The leveling cylinders 45 extend and retract their pistons to slide the leveling hopper 42 inside the screed box 41. The auger 43 is mounted inside the leveling hopper 42 using any suitable means, such as bearings. The screed motor 44 is coupled to the end of the auger 43 through a lengthwise slot in the screed box 41. The slot allows the screed motor 44 and auger 43 to slide along with the leveling hopper 42 when the leveling cylinders 45 extend and retract.

In operation, the first station conveyor 7*a* conveys a form 10 onto a disabled loading conveyor 8*a*. When the form 10 arrives at the form-filling station 3, the bottom assembly 11 is in the assembled position with the cap 12 resting on top in the unlocked position. The lifting cylinder 31 begins in the engagement position so that, as the form 10 arrives at the form filling station 3, the short lifting rail 33 and the tall lifting rail 33 engage a corresponding tall cap bracket 26 and a short cap bracket 25. Upon conveyance onto the loading conveyor 8*a,* the form 10 engages a micro-switch that outputs a signal that overrides the first station conveyor 7*a*. Thus, first station conveyor 7*a* remains disabled during the filling of the form 10. The micro-switch further outputs a signal that retracts the lifting cylinder 31 to the raised position, thereby removing the cap 12. With the cap 12 removed, the operator inserts all necessary electrical conduit or electrical boxes into the form. Next, the lifting cylinder 31, in its retracted position, engages a micro-switch that outputs a signal directing the screed cylinder 46 to extend the screed box 41 to the loading position directly over the bottom assembly 11. In the loading position, the leveling hopper 42 is located directly underneath a filling conveyor 47, which is any suitable conveyor, such as a belt conveyor. As the screed box 40 reaches the loading position, it engages a micro-switch, which outputs a signal that opens a lightweight concrete composite source and activates the filling conveyor 47 to deliver the lightweight concrete composite to the leveling hopper 42. The lightweight concrete composite source in the preferred embodiment is the lightweight concrete composite source disclosed in U.S. patent application Ser. No. 09/887,369, the disclosure of which is incorporated herein by reference. The micro-switch further outputs a signal that activates the screed motor 44, thereby rotating the auger 43 to evenly distribute the lightweight concrete composite throughout the leveling hopper 42. A micro-switch positioned within the leveling hopper 42 or the lightweight concrete composite source senses when either the leveling hopper 42 is full or the lightweight concrete composite source is empty. Upon sensing either condition, the micro-switch outputs a signal closing the lightweight concrete composite source and deactivating the filling conveyor 47 and the screed motor 44.

Figure 7:
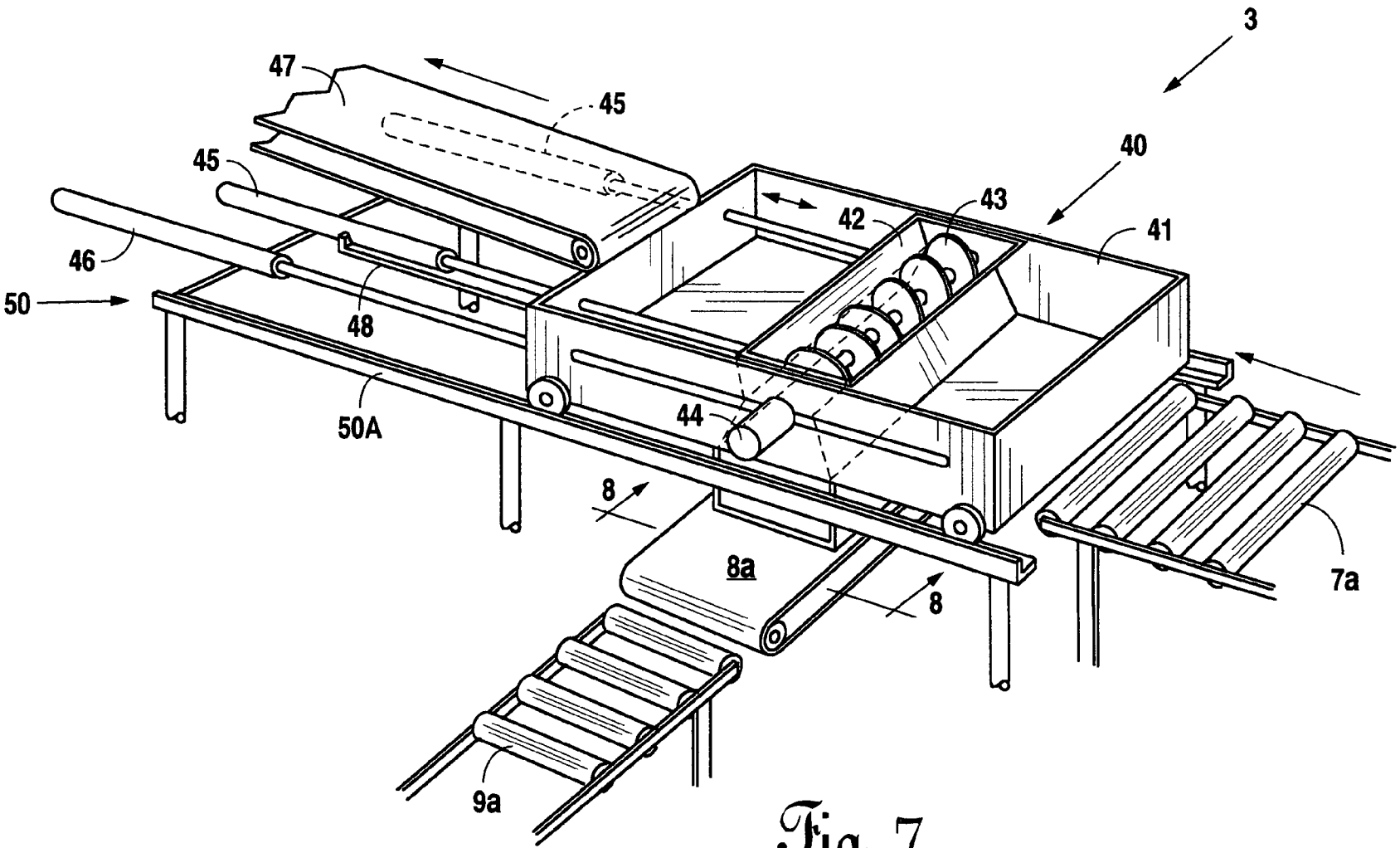
FIG. 7 is a perspective view illustrating a screed assembly for loading and leveling a form.

As generally illustrated in FIGS. 7 and 8, the micro-switch further outputs a signal that activates the leveling cylinders 45, which slowly move the leveling hopper 42 forward over the bottom assembly 11 to a position beyond the bottom assembly 11. When the leveling hopper 42 travels fully beyond the bottom assembly 11, it engages a micro-switch that reverses the leveling cylinders 45, which slowly move the leveling hopper 42 backward over the bottom assembly 11 to the loading position. The movement of the leveling hopper 42 over the bottom assembly 11 fills and levels the bottom assembly 11 with the lightweight concrete composite contained in the leveling hopper 42. As the leveling cylinders 45 fully retract, the leveling hopper 42 engages a micro-switch that outputs a signal resulting in the screed cylinder 46 returning the screed box 41 to the retracted position. When the screed cylinder is fully retracted, a micro-switch outputs a signal that activates the lifting cylinder 31 to extend to the engagement position, thereby replacing the cap 12 back onto the bottom assembly 11. Upon replacement of the cap 12, a micro-switch outputs a signal that activates the loading conveyor 8*a* to move the form 10 forward toward the next station, the form assembly station 4, via the first roller conveyor 9*a*. Upon conveyance of the form 10 from the loading conveyor 8*a,* a micro-switch signals the loading conveyor 8*a* to disable in preparation to receive another form 10.

In the preferred embodiment, the form assembly station 4 is a manually operated station. First, the operator depresses the cap 12 onto the bottom assembly 12, thereby compressing the lightweight concrete composite within the form. Next, the operator couples the latches 18 of the cap 12 to the catches of the bottom assembly 11, thereby sealing the form. Finally, the operator delivers the form from the first roller conveyor 9*a* to the second station conveyor 7*b* to convey the form through the curing oven. While the preferred embodiment discloses a manually operated form assembly station 4, those of ordinary skill in the art will recognize that the form assembly station 4 may be automated.

As illustrated in FIG. 10, the dotted line designates an area of the station conveyor 2 enclosed by the curing oven 5. The second station conveyor 7*b* moves the form 10 through the curing oven 5, which is at a temperature sufficient to accelerate curing. As the form 10 travels through the curing oven 5, the lightweight concrete composite cures. The curing oven 5 should be of a sufficient size to allow adequate time for proper curing to occur. When the form 10 exits the curing oven 5, the lightweight concrete composite has hardened into a unitary lightweight concrete composite block 10A. The second station conveyor 7*b* continues to move the form 10 to the block removal station 6.

Figure 9:
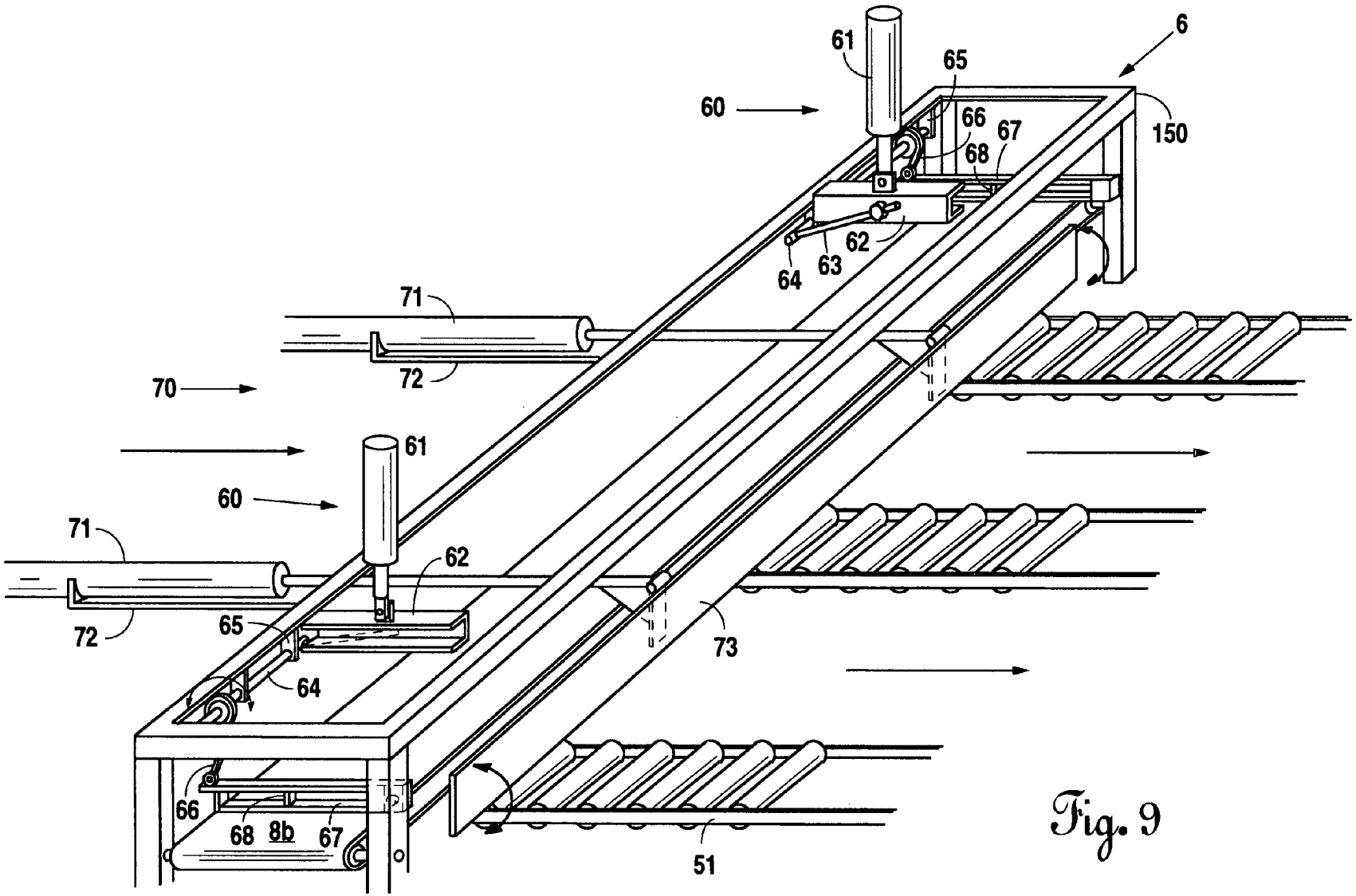
FIG. 9 is a perspective view illustrating a block removal station with a cap removal assembly raised to an upper level, a dispatch assembly in a closed position, and an unloading conveyor.

As illustrated in FIGS. 9 and 10, the last station is a block removal station 6. The block removal station 6 includes a frame 150, a cap removal/lockdown assembly 60, a dispatch assembly 70, and a dispatch conveyor 51. The frame 150 includes four vertical bars and four horizontal crossbars attached together by any suitable means, such as welding, to form a wire-frame box directly over the unloading conveyor 8*b*. The four vertical bars are attached to a base that mounts to a foundation using any suitable means, such as bolts, sunk into the foundation.

The cap removal/lockdown assembly 60 includes lifting cylinders 61, lifting rails 62, rail rods 63, pivot rods 64, support brackets 65, lockdown rods 66, and lockdown rails 67. The lifting cylinders 61 are vertically suspended directly above the frame for extending and retracting from a raised position to an engagement position. The lifting rails 62 are C-shaped rails attached to the ends of the lifting cylinders 61 for engaging the cap brackets 20 of the form 10. Support brackets 65 attached to the frame 150 couple with the pivot rods 64 by any suitable means, such as bearings, so that the pivot rods 64 rotate freely. The rail rods 63 fixedly attach by any suitable means, such as welding, to the pivot rods 64, thereby extending perpendicularly to hingedly attach to the lifting rails 62. The lockdown rods 66 are fixedly attached to the ends of the pivot rods 64 opposite the rail rods 63, thereby extending perpendicularly to hingedly attach to the lockdown rails 67. The lockdown rails 67 are L-shaped channels with a locking tab 68 attached in the center by any suitable means, such as welding, for engaging the pins 24 of the form 10. When the lifting cylinders 61 extend, the lifting rails 62 lower to a position where they may engage the cap brackets 20. Simultaneously, the rail rods 63 rotate the pivot rods 64, which rotate the lockdown rods 66, thereby raising the lockdown rails 67 to a level sufficient to clear any forms 10 located on the unloading conveyor 8*b*. This position will be referred to as the engagement position. Oppositely, when the lifting cylinders 61 retract, thereby raising the lifting rails 62 to remove the cap 12, the lockdown rails 67 lower to engage the pins 24 of the bottom assembly 11. This will be referred to as the lockdown position.

The dispatch assembly 70 includes dispatch cylinders 71, mounting brackets 72, and a ram plate 73. The dispatch cylinders 71 mount horizontally to the frame 150 via the mounting brackets 72. Both dispatch cylinders 71 are hingedly attached to the ram plate 73, whereby the ram plate 73 can rotate between a ram position and a bypass position. When the dispatch cylinders 71 extend, the ram plate 73 remains in a vertical position to strike a concrete composite block 10A and push the concrete composite block 10A onto the dispatch conveyor 51, which will be referred to as the ram position. When the dispatch cylinders 71 retract, the ram plate 73 rotates to a horizontal position to bypass the form 10, which will be referred to as the bypass position.

In operation, the second station conveyor 7*b* delivers a form 10 onto a disabled unloading conveyor 8*b*. In this preferred embodiment, the forms 10 are spaced along the conveyor system 2 such that a form 10 enters the block removal station 6 at the same time another form 10 enters the form-loading station 3. Consequently, the block removal station 6 controls the stopping and starting of the first station conveyor 7*a*. Nevertheless, those of ordinary skill in the art will recognize that the form-loading station 3could control the first station conveyor 7*a*.

Furthermore, although this preferred embodiment discloses the synchronous operation of the block removal station 6 and the form-loading station 3, those of ordinary skill in the art will recognize other control schemes for regulating the movement of the forms through the block removal station 6 and the form-loading station 3.

The lifting cylinders 61 of the cap removal/lockdown assembly 60 begin in the engagement position so that, as the form 10 arrives at the block removal station 6, the cap rails 62 engage the cap brackets 20 of the cap 12. Upon conveyance onto the unloading conveyor 8*b*, the form 10 engages a micro-switch that outputs a signal that overrides the second station conveyor 7*b*. Thus, second station conveyor 7*b* remains disabled during the removal of the block 10A. In addition, the micro-switch outputs a signal that informs an operator to unlock the cap 12 from the bottom assembly 11 by uncoupling the corresponding latches 18 from the catches 19. After this is done, the operator engages a micro-switch that outputs a signal that retracts the lifting cylinders 61 to the lockdown position, thereby removing the cap 12 and locking down the bottom assembly 11. Upon lockdown of the bottom assembly 11, a micro-switch outputs a signal that informs the operator to uncouple the remaining latches 19 on the bottom assembly 11 and rotate the sidewalls 15 down to a horizontal position. Next, the operator engages a micro-switch that outputs a signal to the dispatch cylinders 71 to extend and retract, thereby pushing the finished block 10A onto the dispatch conveyor 51. Then the operator reassembles the bottom assembly 11. Once the finished block 10A is removed and the bottom assembly is reassembled, the operator engages a micro-switch, which outputs a signal to extend the lifting cylinders 61 to the engagement position, thereby placing the cap 12 onto the bottom assembly 11. Finally, the unloading conveyor 8*b* advances the form to the second roller conveyor 9*b* to start the process all over again.

The preferred embodiment employs a micro-switch control scheme whereby the engaging of various micro-switches controls the conveyor system 2, the form-loading station 3, and the block removal station 6. The micro-switches employed are of a type well known to those of ordinary skill in the art, such as optical sensing switches, pressure switches, mechanically activated switches, and the like. Further, the use of such switches to control the components of the apparatus for manufacturing lightweight concrete composite blocks 10A is well known and understood by those of ordinary skill in the art. It should be understood, however, that a computer control scheme could be implemented in the apparatus for manufacturing lightweight concrete composite blocks 10A.

To assemble the lightweight concrete blocks 10A into a functional structure, four types of installation methods are used, standard installation, second level installation, framing installation, and heavy cabinet installation. Standard installation is intended for installation on the first floor of a structure. Second level installation is intended for installation of floors above the first floor. Finally, framing installation is intended for installation around doors and windows, and cabinet installation is intended for the mounting of cabinets onto the lightweight concrete blocks 10A.

In a standard installation, the first step is to erect a support frame. As shown in FIG. 11, the support frame 100 in the preferred embodiment includes a side support 101, a base support 102, and a top support 103. All three supports are made from "C" channel, which is erected using application methods commonly known in the industry. After erecting the support frame, matching sides of the base support 102 and the top support 103 are folded parallel with the foundation. Next, an adhesive, such as glue, is applied to the inside of the support frame 100. A first block 104 is then placed vertically into the support frame 100 so that it rests at the farthest end of the support frame 100, and the adhesive is allowed to dry. After applying more adhesive, a second block 105 is placed vertically into the support frame so that the tongue of the block 105 inserts into the groove of the first block 104. The above process is thus repeated until the entire support frame 100 is filled with blocks. At that time, the base support 102 and top support 103 are folded back to the original "C" channel shape. Finally, the entire structure is secured by installing screws through the support frame 100 into the blocks.

Figure 12:
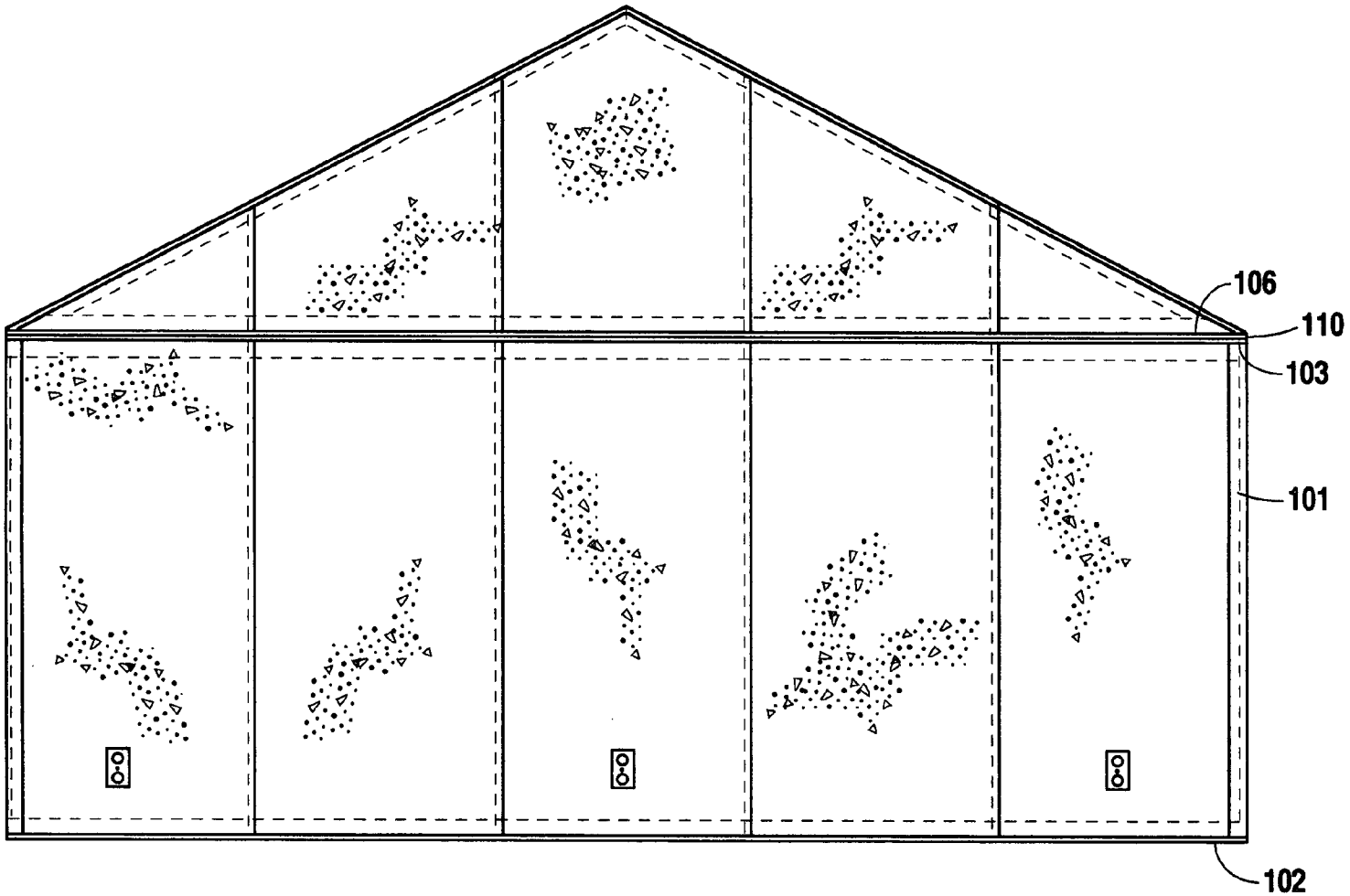
FIG. 12 is a front view illustrating a second level installation.

Referring to FIG. 12, to install a second level or higher, a first or lower level must be installed as described above. Then, an intermediate support 110, which is a "C" channel, must be attached with any suitable method such as glue or screws, to the top support 103 with the "C" facing down. Next, a base support 106, which is a "C" channel, is mounted facing up to the intermediate support 110 using any suitable method, such as glue or screws. With the base support 102 mounted, the rest of level is installed according to the steps described above in the standard installation.

Figure 14:
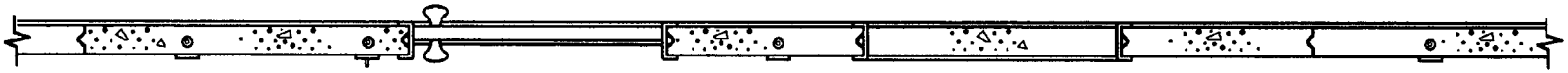
FIG. 14 is an overhead view illustrating a framing installation and a heavy cabinet installation.
Figure 13:
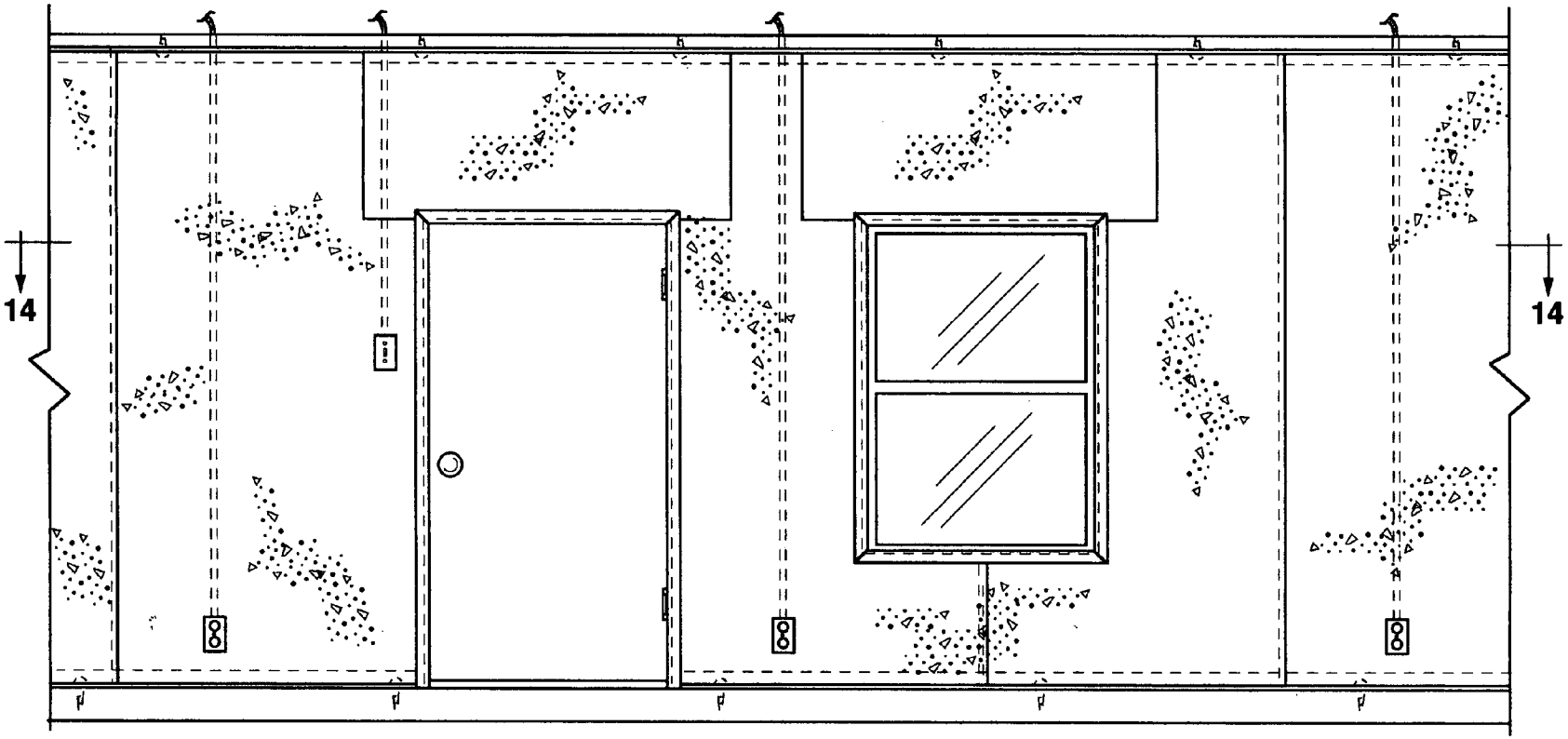
FIG. 13 is a front view illustrating a framing installation and a heavy cabinet installation.

Referring to FIGS. 13 and 14, windows and doors may be "framed" with methods that are well known in the trade. Illustratively, an opening for a window or door is cut into a block. A frame for the window or door is then secured to the block at the edges of the opening using any suitable technique such as screws or adhesives. The window or door is then installed in the frame using techniques well known to those of ordinary skill in the art.

Referring to FIGS. 13 and 14, heavy cabinet installation requires a section of wall to be installed as described above. After erecting the wall, a lower "C" channel and an upper "C" channel are attached to a block of the wall using a suitable means, such as screws. Next, a left "C" channel and a right "C" channel are attached to either the block of the wall or more preferably to the "C" channel of the support frame using a suitable means, such as screws. Then, the outer sections of upper, lower, left, and right "C" channels are folded perpendicular to the wall so that a cabinet may be received therein. Finally a cabinet is placed in the upper, lower, left, and right "C" channels and secured to the wall and the upper, lower, left, and right "C" channels using any suitable means, such as screws.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

What is claimed is:

1. An apparatus for manufacturing lightweight concrete composite blocks, comprising:
- a form defining a desired shape that holds a volume of composite;
- a form loading station, comprising:
  - a cap removal/replacement assembly that removes and replaces a cap of the form, the cap removal/replacement assembly, comprising:
    - a short lifting rail adapted to engage a short cap bracket of the form,
    - a tall lifting rail adapted to engage a tall cap bracket of the form,
    - a stabilizer bar connecting the short lifting rail and the tall lifting rail, and
    - a lifting cylinder attached to the stabilizer bar, wherein the lifting cylinder moves between an engagement position and a raised position, and
  - a screed assembly that receives composite and delivers the composite into a bottom assembly of the form;
- a form assembly station that facilitates assembly of the form;
- a station conveyor that conveys the form about the apparatus in a continuous loop;
- a curing oven, wherein the station conveyor conveys the composite-filled form from the form loading station through the curing oven, thereby curing the composite into a lightweight concrete composite block; and
- a block removal station that, upon delivery of the form from the curing oven via the station conveyor, removes the lightweight concrete composite block from the form.

2. The apparatus according to claim 1, wherein the screed assembly comprises:
- a screed track extending over the station conveyer;
- a screed box coupled with the screed track;
- a screed cylinder coupled with the screed box, whereby the screed cylinder conveys the screed box along the screed track between a retracted position and a loading position;
- a leveling hopper disposed within the screed box that fills and levels the form with composite; and
- a leveling cylinder coupled with the leveling hopper, whereby the leveling cylinder slides the leveling hopper back and forth inside the screed box.

3. The apparatus according to claim 2, wherein the screed assembly further comprises:
- an auger disposed within the leveling hopper that evenly distributes composite into the form; and
- a screed motor coupled with the auger, whereby the screed motor rotates the auger.

4. The apparatus according to claim 2, wherein in the retracted position the screed box allows the cap removal/replacement assembly to engage the form.

5. The apparatus according to claim 2, wherein in the loading position the screed box is directly over the form.

6. An apparatus for manufacturing lightweight concrete composite blocks, comprising:
- a form defining a desired shape that holds a volume of composite;
- a form loading station that receives composite and delivers the composite to the form;
- a form assembly station that facilitates assembly of the form;

a station conveyor that conveys the form about the apparatus in a continuous loop;

a curing oven, wherein the station conveyor conveys the composite-filled form from the form loading station through the curing oven, thereby curing the composite into a lightweight concrete composite block;

a block removal station that, upon delivery of the form from the curing oven via the stationer conveyor, removes the lightweight concrete composite block from the form; and the station conveyor, comprising:

a first station conveyor that conveys unloaded forms to the form loading station;

a loading conveyor that receives from the first station conveyor unloaded forms for filling with composite and that delivers loaded forms from the form loading stations, a first roller conveyor that receives from the loading conveyor loaded forms and that delivers the loaded forms to the form assembly stations, a second station conveyor that receives from the first roller conveyor loaded forms and that conveys loaded and assembled forms from the form assembly station through the curing oven and to the block removal station;

an unloading conveyor that receives from the second station conveyor forms filled with cured composite and that delivers unloaded forms from the block removal station, and a second roller conveyor that receives from the unloading conveyor unloaded forms and that delivers the unloaded forms to the first station conveyor.

7. An apparatus for manufacturing lightweight concrete composite blocks, comprising:

a form defining a desired shape that holds a volume of composite;

a form loading station that receives composite and delivers the composite to the form;

a form assembly station that facilitates assembly of the form;

a station conveyor that conveys the form about the apparatus in a continuous loop:

a curing oven, wherein the station conveyor conveys the composite-filled form from the form loading station through the curing oven, thereby curing the composite into a lightweight concrete composite block; and a block removal station that, upon delivery of the form from the curing oven via the station conveyor, removes the lightweight concrete composite block from the form, the block removal station, comprising:

a cap removal/lockdown assembly that removes and replaces a cap of the form and that locks down a bottom assembly of the form, the cap removal/lockdown assembly, comprising, at least one lifting rail adapted to engage a cap bracket attached to the cap of the form, at least one lockdown rail adapted to engage a pin attached to the bottom assembly of the form, whereby the lifting rail and the lockdown rail are pivotally connected together, and at least one lifting cylinder attached to the lifting rail, wherein the lifting cylinder moves between an engagement position whereby the lifting rail engages the cap bracket and a lockdown position whereby the lifting cylinder raises the lifting rail to remove the cap from the bottom assembly and further whereby the raising of the lifting rail pivots the lockdown rail such that the lockdown rail engages the pin to lock down the bottom assembly of the form, a dispatch assembly that removes a cured block from a locked down bottom assembly of the forms, and a frame that supports the cap removal/lockdown assembly and the dispatch assembly.

8. The apparatus according to claim 7, wherein the block removal station further comprises a dispatch conveyor that receives a removed cured block from the dispatch assembly and conveys the removed cured block therefrom.

9. The apparatus according to claim 7, wherein the lifting rail and the lockdown rail are pivotally connected together by:

at least one rail rod secured at one end to the lifting rail;

at least one pivot rod secured at one end to the lifting rail;

at least one support bracket securing a second end of the pivot rod to the frame, whereby the support bracket permits free rotation of the pivot rod; and at least one lockdown rod secured at one end to the pivot rod and at a second end to the lockdown rail.

10. An apparatus for manufacturing lightweight concrete composite blocks, comprising:

a form defining a desired shape that holds a volume of composite;

a form loading station that receives composite and delivers the composite to the form;

a form assembly station that facilitates assembly of the form;

a station conveyor that conveys the form about the apparatus in a continuous loop;

a curing oven, wherein the station conveyor conveys the composite-filled form from the form loading station through the curing oven, thereby curing the composite into a lightweight concrete composite block; and a block removal station that, upon delivery of the form from the curing oven via the station conveyor, removes the lightweight concrete composite block from the form, the block removal station, comprising:

a cap removal/lockdown assembly that removes and replaces a cap of the form and that locks down a bottom assembly of the form, a dispatch assembly that removes a cured block from a locked down bottom assembly of the form, the dispatch assembly, comprising:

at least one dispatch cylinder mounted on the frame, and a ram plate hingedly attached to the dispatch cylinder, wherein the ram plate moves between a ram position and a bypass position whereby, when the dispatch cylinder extends, the ram in the ram position pushes a block from the form and further whereby, when the dispatch cylinder retracts, the ram in the bypass position rotates to bypass the form, and a frame that supports the cap removal/lockdown assembly and the dispatch assembly.

11. The apparatus according to claim 10, wherein the block removal station further comprises a dispatch conveyor that receives a removed cured block from the dispatch assembly and conveys the removed cured block therefrom.

* * * * *